US006067056A

United States Patent [19]

Lake

[11] Patent Number: 6,067,056

[45] Date of Patent: May 23, 2000

[54] METHODS OF FORMING CONDUCTIVE LINES, METHODS OF FORMING ANTENNAS, METHODS OF FORMING WIRELESS COMMUNICATION DEVICES, CONDUCTIVE LINES, ANTENNAS, AND WIRELESS COMMUNICATIONS DEVICES

[75] Inventor: Rickie C. Lake, Eagle, Id.

[73] Assignee: Micron Technology, Inc., Boise, Id.

[21] Appl. No.: 09/255,847

[22] Filed: Feb. 23, 1999

Related U.S. Application Data

[62] Division of application No. 08/926,189, Sep. 9, 1997.

[51] Int. Cl.[7] ..... H01Q 1/38

[52] U.S. Cl. ..... 343/873; 343/700 MS; 343/795

[58] Field of Search ..... 340/825.54; 343/700 MS, 343/866, 769, 795; 257/99; 361/410; 156/630, 634

[56] References Cited

U.S. PATENT DOCUMENTS 4,987,421 1/1991 Sunahara et al. ..... 343/700 MS

OTHER PUBLICATIONS

U.S. application No. 08/705,043, filed Aug. 29, 1999, O'Toole et al.

*Primary Examiner*—Don Wong
*Assistant Examiner*—James Clinger
*Attorney, Agent, or Firm*—Wells, St. John, Roberts, Gregory & Matkin P.S.

[57] ABSTRACT

Methods of forming conductive lines, antennas, and wireless communications devices, and related conductive lines, antennas and wireless communications devices are described. In one aspect, a substrate having an outer surface is provided. A first layer of conductive material is formed over the outer surface. A second layer of conductive material is formed over only portions of the first layer. Using the second layer as a masking layer, the first layer is etched selectively relative thereto to provide a conductive line comprising the first and second layers. Preferably, the first layer is more conductive than the second layer. In a preferred implementation, the conductive line constitutes an antenna construction which is suitable for use in a wireless communications device. In another preferred implementation, an antenna, an integrated circuitry chip, and a battery are mounted on a substrate and operably interconnected to provide an integrated circuitry chip, with the antenna being formed as described above.

18 Claims, 3 Drawing Sheets

METHODS OF FORMING CONDUCTIVE LINES, METHODS OF FORMING ANTENNAS, METHODS OF FORMING WIRELESS COMMUNICATION DEVICES, CONDUCTIVE LINES, ANTENNAS, AND WIRELESS COMMUNICATIONS DEVICES

RELATED PATENT DATA

This patent resulted from a divisional application of U.S. patent application Ser. No. 08/926,189, filed Sep. 9, 1997, entitled "Methods of Forming Conductive Lines, Methods of Forming Antennas, Methods of Forming Wireless Communication Devices, Conductive Lines, Antennas, and Wireless Communications Devices", naming Rickie C. Lake as inventor, the disclosure of which is incorporated by reference.

TECHNICAL FIELD

This invention relates generally to methods of forming conductive lines, methods of forming antennas, methods of forming wireless communication devices, and to conductive lines, antennas, and wireless communications devices.

BACKGROUND OF THE INVENTION

Often times during fabrication of various electronic devices, it is desirable to provide a conductive line which has a desired degree of conductivity. Yet, a desired material from which such conductive line is formed may not possess the requisite degree of conductivity. Accordingly, it would be desirable to form such conductive lines to have the desired degree of conductivity.

Some antennas are formed from conductive lines supported by a substrate. The conductivity of a particular antenna affects its operation, as such pertains to its electromagnetic behavior. For example, the conductivity can affect the resonance of such antennas, which can impact the overall frequencies at which such antennas operate.

Some wireless communications devices are very small and, by virtue of their dimensions, dictate the types and amounts of materials which can be utilized to form an antenna. In some instances, achieving a desired degree of conductivity might be possible by using more of a particular antenna-forming material, such as by making the conductive antenna lines thicker, wider, or longer, or in a different shape. Yet, the desired dimensions of such devices may preclude such modified configurations.

This invention arose out of concerns associated with providing more conductive antenna lines of desired materials without consuming more space on or over a substrate upon which the antenna lies. The artisan will appreciate applicability of the disclosed technology in other areas, with the invention only being limited by the accompanying claims appropriately interpreted in accordance with the Doctrine of Equivalents.

SUMMARY OF THE INVENTION

Methods of forming conductive lines, antennas, and wireless communications devices, and related conductive lines, antennas and wireless communications devices are described. In one aspect, a substrate having an outer surface is provided. A first layer of conductive material is formed over the outer surface. A second layer of conductive material is formed over only portions of the first layer. Using the second layer as a masking layer, the first layer is etched selectively relative thereto to provide a conductive line comprising the first and second layers. Preferably, the first layer is more conductive than the second layer. In a preferred implementation, the conductive line constitutes an antenna construction which is suitable for use in a wireless communications device. In another preferred implementation, an antenna, an integrated circuitry chip, and a battery are mounted on a substrate and operably interconnected to provide an integrated circuitry chip, with the antenna being formed as described above.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
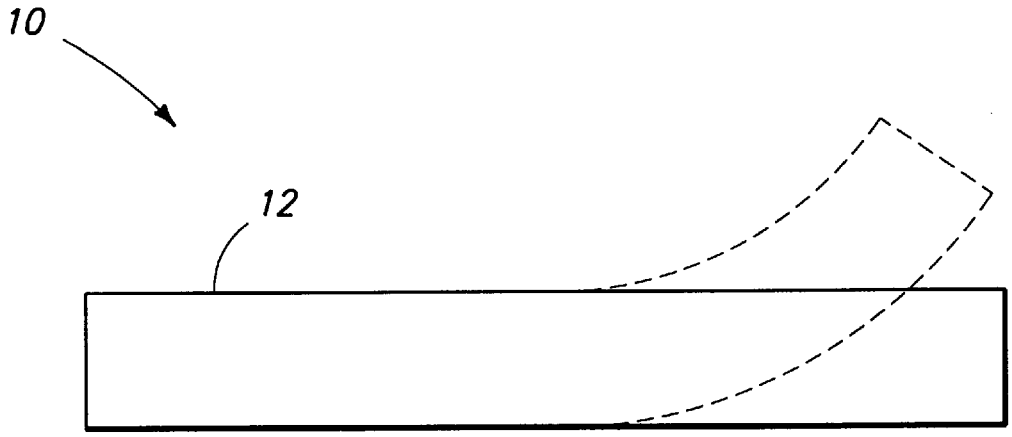
FIG. 1 is a cross-sectional view of a substrate in accordance with one aspect of the invention.

Referring to FIG. 1, a substrate is indicated generally at 10 and includes an outer surface 12. In one aspect, substrate 10 constitutes a polyester material which possesses a degree of flexibility prior to the processing which is described just below. Such flexibility is indicated generally in dashed lines.

Figure 2:
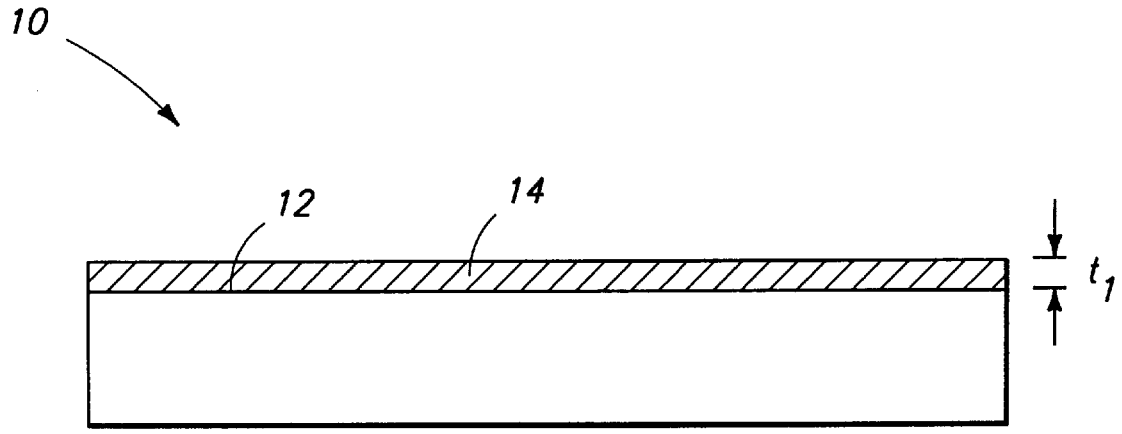
FIG. 2 is a view of the FIG. 1 substrate at a processing step subsequent to that shown by FIG. 1.

Referring to FIG. 2, a first conductive layer 14 having a first conductivity is formed over outer surface 12 and preferably comprises a metal-comprising material. In a preferred implementation, layer 14 constitutes a film layer comprising copper which is formed or coated over the substrate to a thickness $t_1$. An exemplary thickness for layer 14 is between about 0.03 mil to 2 mils.

Figure 3:
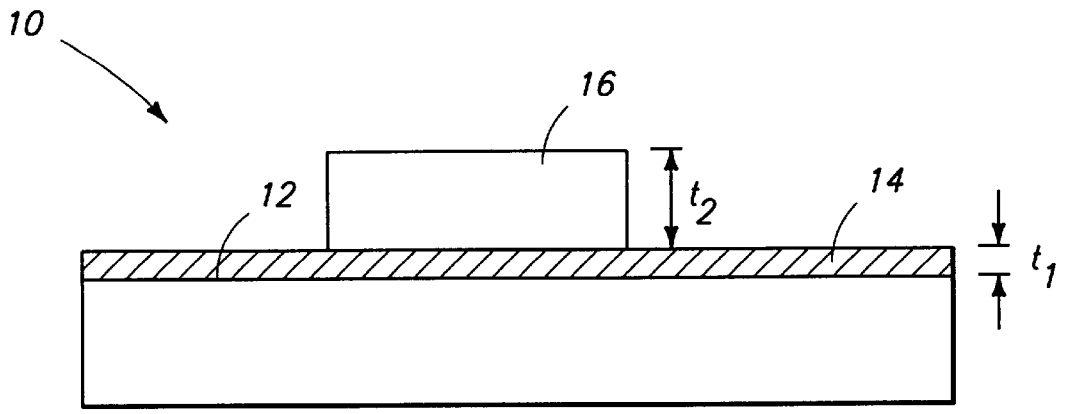
FIG. 3 is a view of the FIG. 1 substrate at a processing step subsequent to that shown by FIG. 2.

Referring to FIG. 3, a second conductive layer 16 having a second conductivity is formed over only portions of first layer 14 and accordingly masks those portions over which it is formed. Preferably, the first conductivity is greater than the second conductivity. Accordingly, those portions of layer 14 over which layer 16 material is not formed are not masked thereby. In a preferred aspect, the formation of layers 14, 16 comprises at least two separate steps. Layer 16 constitutes a conductive film line component which is preferably formed to a thickness $t_2$ which is greater than thickness $t_1$. An exemplary thickness for layer 16 is between about 0.3 mil to 2 mils. In a preferred aspect, layer 16 constitutes an antenna component in a desired antenna shape. An exemplary and preferred material for layer 16 comprises silver in the form of a silver-filled polymer layer. An example is part number P2607 available through a company called EMCA-REMEX of Montgomeryville, Pa. Other materials include carbon-filled polymer thick film inks. An exemplary material is a conductive carbon coating bearing part number M-5000-CR, available through a company called Minico of Congers, N.Y.

In a preferred aspect, layer 16 is printed directly onto layer 14, and even more preferably, such layer is screen-printed directly thereon. Accordingly, the screen-printing of layer 16 enables a pre-configured or pre-defined antenna component to be formed only over certain portions of first layer 14. It is possible, however, for other formation techniques to be utilized. Alternately considered, layers 14 and 16 constitute at least two layers of different conductive material which are formed over one another. One of the layers (the less conductive layer 16), is preferably formed over the other of the layers (the more conductive layer 14).

Figure 4:
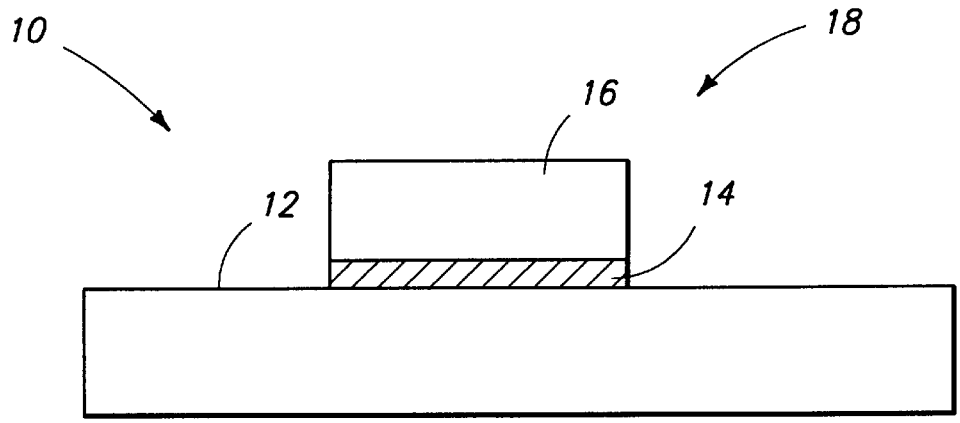
FIG. 4 is a view of the FIG. 1 substrate at a processing step subsequent to that shown by FIG. 3.

Referring to FIG. 4, a conductive device component 18 is formed over substrate 10 by selectively removing unmasked portions of layer 14 (FIG. 3) relative to layer 16. In a preferred aspect, unmasked portions of layer 14 are anisotropically etched. An exemplary etch chemistry where layer 14 is copper and layer 16 is a silver polymer comprises ammonia in combination with one or both of ammonium chloride or ammonium sulfate. Such provides an antenna having a composite construction with layers which are disposed in operative contact relative to one another such that the overall conductivity of device component 18 is greater than the conductivity of layer 16 material standing alone.

Figure 5:
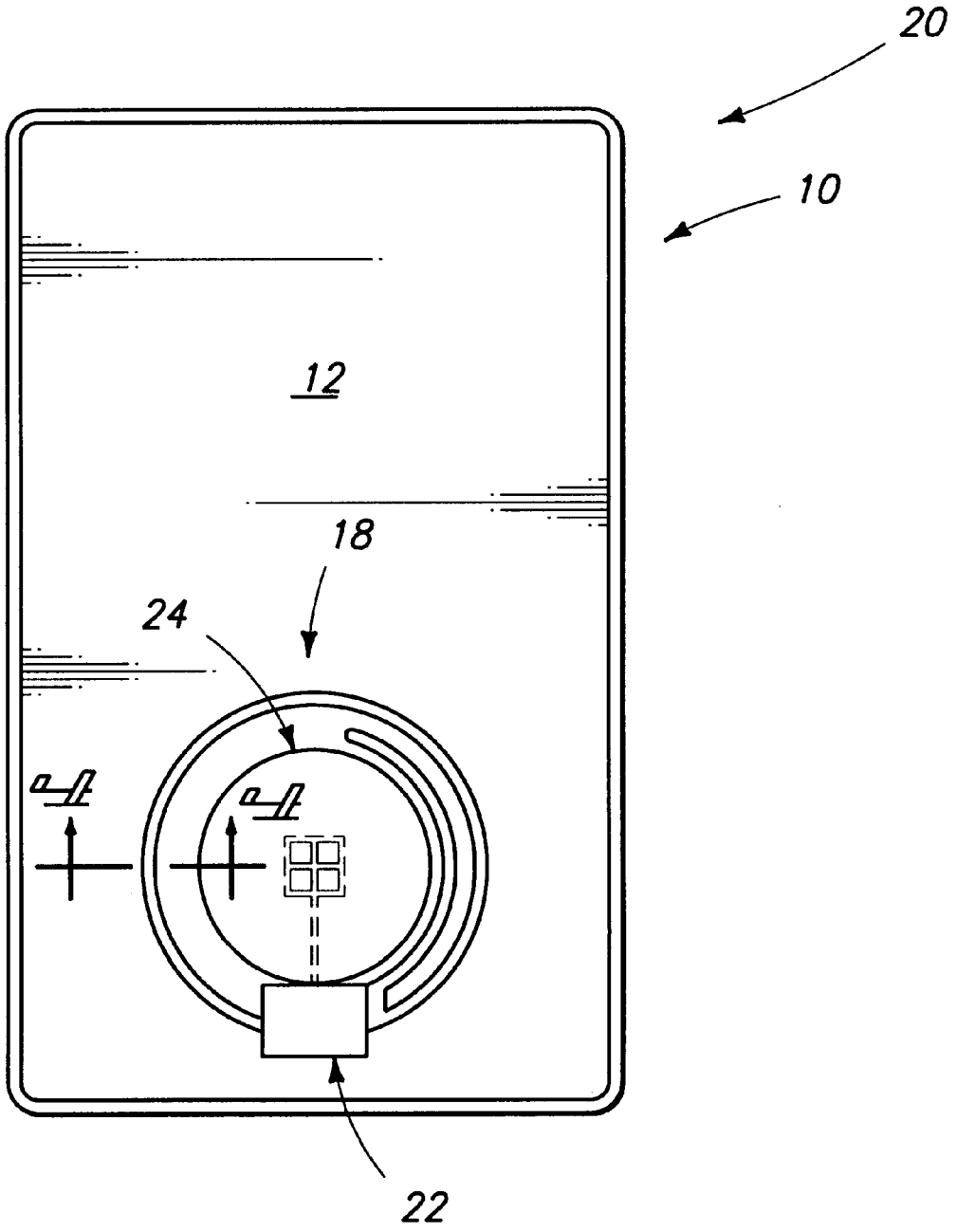
FIG. 5 is a view of a wireless communications device constructed in accordance with one aspect of the present invention.

Referring to FIG. 5, a wireless communication device is indicated generally at 20 and comprises substrate 10 and device component 18. Device component 18 is preferably in the form of an antenna which is configured for wireless radio frequency operation. In the illustrated example, the antenna constitutes a loop antenna. In a preferred aspect, an integrated circuitry chip 22 and a battery 24 are provided and mounted to substrate 10 and are in operative electrical communication with antenna or conductive device component 18. Communication device 20 is preferably encapsulated with an encapsulating material and configured for radio frequency communication. In one preferred aspect, wireless communication device 20 has an outer surface and a thickness relative thereto (into the plane of the page upon which FIG. 5 appears) of less than or equal to about 90 mils. Even more preferably, such thickness is less than or equal to about 30 mils. An exemplary wireless communication device is described in U.S. patent application Ser. No. 08/705,043, which names James O'Toole, John R. Tuttle, Mark E. Tuttle, Tyler Lowrey, Kevin Devereaux, George Pax, Brian Higgins, Shu-Sun Yu, David Ovard and Robert Rotzoll as inventors, which was filed on Aug. 29, 1996, is assigned to the assignee of this patent application, and is fully incorporated herein by reference.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An antenna comprising:

a polyester substrate;

a first film layer of metal-comprising material disposed over only a portion of the substrate, the first layer having a first conductivity; and a second film layer of material disposed on the first film layer and having a second conductivity which is less than the first conductivity.

2. The antenna of claim 1, wherein the first film layer comprises a copper-comprising material.

3. The antenna of claim 1, wherein the second film layer comprises a silver-comprising material.

4. The antenna of claim 1, wherein the first film layer is thinner than the second film layer.

5. The antenna of claim 4, wherein the second film layer comprises a silver-comprising material.

6. The antenna of claim 1, wherein the first film layer comprises copper and the second film layer comprises silver.

7. An antenna comprising:

a substrate;

a first film layer of metal-comprising material disposed over only a portion of the substrate, the first layer having a first conductivity; and a second film layer of material disposed on the first film layer and having a second conductivity which is less than the first conductivity, wherein the first film layer comprises copper and the second film layer comprises a conductive carbon coating.

8. The antenna of claim 1, wherein the first and second film layers form a loop antenna.

9. A wireless communication device comprising:

a polyester substrate;

an antenna layered on the substrate and having a composite construction which includes a first layer of conductive material and a second layer of less conductive material disposed in operative contact with the first layer; and an integrated circuitry chip and a battery mounted to the substrate and in operative electrical communication with the antenna.

10. The wireless communication device of claim 9, wherein the first layer is disposed between the substrate and the second layer.

11. The wireless communication device of claim 9, wherein the device includes an outer surface and has a thickness relative to the outer surface less than or equal to about 90 mils.

12. The wireless communication device of claim 9, wherein the device includes an outer surface and has a thickness relative to the outer surface less than or equal to about 30 mils.

13. The wireless communication device of claim 9, wherein the first layer is thinner than the second layer.

14. The wireless communication device of claim 9, wherein the second layer comprises a silver-comprising material.

15. The wireless communication device of claim 9, wherein the device is configured for radio frequency communication.

16. The wireless communication device of claim 9, wherein the first and second film layers form a loop antenna.

17. A wireless communication device comprising:

a substrate;

an antenna layered on the substrate and having a composite construction which includes a first layer of conductive material and a second layer of less conductive material disposed in operative contact with the first layer; and an integrated circuitry chip and a battery mounted to the substrate and in operative electrical communication with the antenna, wherein the first film layer comprises copper and the second film layer comprises silver-loaded polymer.

18. A wireless communication device comprising:

a substrate;

an antenna layered on the substrate and having a composite construction which includes a first layer of conductive material and a second layer of less conductive material disposed in operative contact with the first layer; and an integrated circuitry chip and a battery mounted to the substrate and in operative electrical communication with the antenna.

* * * * *

UNITED STATES PATENT AND TRADEMARK OFFICE

CERTIFICATE OF CORRECTION

PATENT NO. : 6,067,056
DATED : May 23, 2000
INVENTOR(S) : Rickie C. Lake

It is certified that error appears in the above-identified patent and that said Letters Patent is hereby corrected as shown below:

Column 4,
Line 65, insert -- , wherein the second layer comprises a conductive carbon coating -- after the word *antenna*..

The claim should read as follows,
"A wireless communication device comprising: a substrate;
an antenna layered on the substrate and having a composite construction which includes a first layer of conductive material and a second layer of less conductive material disposed in operative contact with the first layer; and an integrated circuitry chip and a battery mounted to the substrate and in operative electrical communication with the antenna, wherein the second layer comprises a conductive carbon coating."

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*